US007613435B2

(12) United States Patent
Reynolds et al.

(10) Patent No.: US 7,613,435 B2
(45) Date of Patent: Nov. 3, 2009

(54) METHOD FOR PROVIDING SATELLITE RADIO SERVICE IN A VEHICLE

(75) Inventors: Lisa Reynolds, Northville, MI (US); Francis Luk, Ann Arbor, MI (US); Mounir Hider, Dearborn Heights, MI (US); Sukhwinder Wadhwa, Windsor (CA)

(73) Assignee: Ford Motor Company, Dearborn, MI (US)

( * ) Notice: Subject to any disclaimer, the term of this patent is extended or adjusted under 35 U.S.C. 154(b) by 540 days.

(21) Appl. No.: 11/426,079

(22) Filed: Jun. 23, 2006

(65) Prior Publication Data

US 2007/0298737 A1 Dec. 27, 2007

(51) Int. Cl.
*H04H 1/00* (2006.01)

(52) U.S. Cl. ..... 455/152.1; 455/3.02; 455/345

(58) Field of Classification Search ..... None
See application file for complete search history.

(56) References Cited

U.S. PATENT DOCUMENTS

| | | | | |
|---|---|---|---|---|
| 6,128,482 | A | 10/2000 | Nixon et al. | |
| 6,462,665 | B1 * | 10/2002 | Tarlton et al. | 340/601 |
| 6,490,513 | B1 * | 12/2002 | Fish et al. | 701/35 |
| 2003/0012152 | A1 * | 1/2003 | Feldman et al. | 370/316 |
| 2003/0204577 | A1 | 10/2003 | Videtich | |
| 2003/0207682 | A1 | 11/2003 | Videtich | |
| 2004/0023647 | A1 | 2/2004 | Mazzara, Jr. et al. | |
| 2004/0054443 | A1 * | 3/2004 | Hall et al. | 701/1 |
| 2004/0259524 | A1 | 12/2004 | Watkins et al. | |
| 2005/0098510 | A1 * | 5/2005 | Lom et al. | 211/13.1 |
| 2005/0107035 | A1 | 5/2005 | Zoeckler | |
| 2005/0130585 | A1 | 6/2005 | Gnuschke et al. | |
| 2005/0215194 | A1 * | 9/2005 | Boling et al. | 455/3.02 |
| 2005/0239450 | A1 | 10/2005 | Wesby | |
| 2005/0283284 | A1 * | 12/2005 | Grenier et al. | 701/29 |

FOREIGN PATENT DOCUMENTS

| | | |
|---|---|---|
| JP | 2002304376 | 10/2002 |
| WO | 2005022935 A2 | 7/2004 |

* cited by examiner

*Primary Examiner*—Tan Trinh
(74) *Attorney, Agent, or Firm*—Damian Porcari Brooks Kushman P.C.

(57) ABSTRACT

An aspect of the invention provides a method for providing satellite radio service in a vehicle. A satellite radio may be activated before a customer purchases the vehicle. The satellite radio may remain active until it receives a deactivation signal.

20 Claims, 3 Drawing Sheets

METHOD FOR PROVIDING SATELLITE RADIO SERVICE IN A VEHICLE

BACKGROUND OF THE INVENTION

1. Field of the Invention

The invention relates to a method for providing satellite radio service in a vehicle.

2. Background Art

Once a customer purchases a vehicle with a satellite radio, the customer may activate the satellite radio by tuning the satellite radio to an activation channel for a period of time. A satellite radio service provider broadcasts a satellite radio activation signal at predetermined intervals.

Once a customer purchases a vehicle with a satellite radio, the customer may activate the satellite radio by informing a satellite radio service provider of the satellite radio's identification number while the satellite radio is on. The satellite radio service provider then broadcasts a satellite radio activation signal to activate the satellite radio.

The above methods may inconvenience a customer because of the time associated with activating the satellite radio module. Also, the customer may not be able to fully evaluate satellite radio service when they are deciding to purchase a vehicle because the satellite radio may have limited or no functionality.

A manufacturer or dealer may activate a vehicle's satellite radio before the customer purchases the vehicle by the above methods. The manufacturer or dealer, however, is similarly inconvenienced because of the time associated with activating the satellite radio.

A manufacturer may activate a satellite radio by connecting it to a fixture that will download firmware to the satellite radio. The firmware may allow the satellite radio to play a preview channel broadcast by a satellite radio service provider for a predetermined period of time less than the useful life of the vehicle. Once the period of time expires, the firmware disables the satellite radio from playing the preview channel. In order to extend service beyond the period of time, a customer, dealer, or manufacturer may need to contact the satellite radio service provider and perform one of the methods discussed above.

A method for providing satellite radio service in a vehicle is desired that reduces the inconvenience associated with activating a satellite radio. A method is also desired that will allow a customer to fully evaluate satellite radio service before purchasing the service.

SUMMARY OF THE INVENTION

An aspect of the invention provides a method for providing satellite radio service in a vehicle. The method includes arranging a satellite radio module in communication with a satellite radio activation circuit. The method also includes transferring satellite radio activation information from the circuit to the module and storing the activation information in memory. The method further includes enabling the module to play at least a subset of signals the module receives from a satellite broadcast. The method still further includes configuring the module to deactivate in the event it receives a deactivation signal from the satellite broadcast.

An aspect of the invention provides a method for providing satellite radio service in a vehicle. The method includes installing a satellite radio module in the vehicle. The method also includes collecting transaction information including a transaction date associated with the vehicle. The method further includes storing at least a subset of the transaction information in memory and transmitting a message including the transaction date to a satellite radio service provider.

An aspect of the invention provides a method for providing satellite radio service for a satellite radio module in a vehicle. The method includes receiving a message including a transaction date associated with the vehicle and determining whether a preactivation duration exceeds a predetermined period of time. The method also includes transmitting a signal containing deactivation information for the module if the preactivation duration exceeds the predetermined period of time. The method further includes disabling the module from playing at least a subset of signals the module receives from a satellite broadcast.

An embodiment of the invention provides a satellite radio module that is connected with a satellite radio service provider via a secure internet portal. Through this connection, the module and the satellite radio service provider produce a "handshake" verifying the authenticity of the module and its electronic serial number. The satellite radio service provider provides a coded key via the internet portal to the module thus activating the module.

An embodiment of the invention provides preactivated satellite radio service. The service provides a seamless delivery of a full channel line-up that is ready to use at the time of vehicle sale. A potential customer can evaluate the satellite radio service before purchasing the service. The preactivated satellite radio service reduces a customer's inconvenience associated with the activation and set-up of a satellite radio. A customer can tie costs associated with the satellite radio service with the financing of the vehicle.

An embodiment of the invention provides a satellite radio that arrives at a vehicle assembly plant already activated.

An embodiment of the invention provides a satellite radio module that is preactivated at a factory and then installed in a vehicle during vehicle assembly. When the vehicle arrives at a dealership, a complete line-up of satellite channels are available for customers to evaluate. When the vehicle is sold, a satellite radio service provider is notified. The satellite radio module will remain activated until the satellite radio module receives a deactivation signal from the satellite radio service provider.

An embodiment of the invention provides a life cycle to manage a preactivated satellite radio module and associated service. The life cycle begins when the module is preactivated by a supplier of satellite radio modules and continues until the module is decommissioned. The life cycle has several stages.

The first stage begins with the supplier of the satellite radio module and ends at a vehicle dealership. The stage includes module personalization, vehicle identification number and electronic serial number pairing, and delivery to a vehicle dealer. The vehicle identification number and electronic serial number are used as a unique identifier to facilitate financial transactions and subscription management throughout the life of the vehicle.

If a satellite radio service provider is not notified within seven months, for example, that the vehicle has been shipped from the assembly plant, the satellite radio service provider will transmit a deactivation signal for the satellite radio module.

The second stage begins at a vehicle dealership and ends when the vehicle is sold. The module is fully capable during this stage allowing potential customers to experience the benefits of satellite radio service prior to vehicle purchase.

If the satellite radio service provider is not notified within twenty months, for example, that the vehicle has been sold, the satellite radio service provider will transmit a deactivation signal for the satellite radio module.

The third stage begins when the vehicle is sold and ends when the module is decommissioned. At the time of vehicle purchase, the customer may indicate that they wish to receive satellite radio service for a certain period of time and finance the costs associated with the satellite radio service along with the vehicle.

The third stage may have two sub-stages. The first sub-stage lasts for a period of 8 months, for example, following vehicle sale. The customer continues to receive satellite radio service during this period. Before the expiration of the eight-month period, the satellite radio service provider contacts the customer to determine whether the customer would like to extend service beyond the eight-month period. If so, the satellite radio service provider will not transmit a deactivation signal for the satellite radio module at the expiration of the eight-month period thus extending service into the second sub-stage. If not, at the expiration of the eight-month period, the satellite radio service provider will transmit a signal to deactivate the satellite radio module.

An embodiment of the invention provides a service provisioning process to support factory installed satellite radios.

An embodiment of the invention provides customers with a delivery and activation experience that eliminates a customer activation requirement and offers a full channel line-up to potential customers prior to vehicle purchase.

An embodiment of the invention enables revenue sharing between a vehicle manufacturer and a satellite radio service provider.

An embodiment of the invention increases the efficiency of providing satellite radios and satellite radio service by automating data collection, reducing paperwork associated with providing satellite radios and satellite radio service, and eliminating customer activities associated with activating a satellite radio.

While exemplary embodiments in accordance with the invention are illustrated and disclosed, such disclosure should not be construed to limit the claims. It is anticipated that various modifications and alternative designs may be made without departing from the scope of the invention.

DETAILED DESCRIPTION

Figure 1:
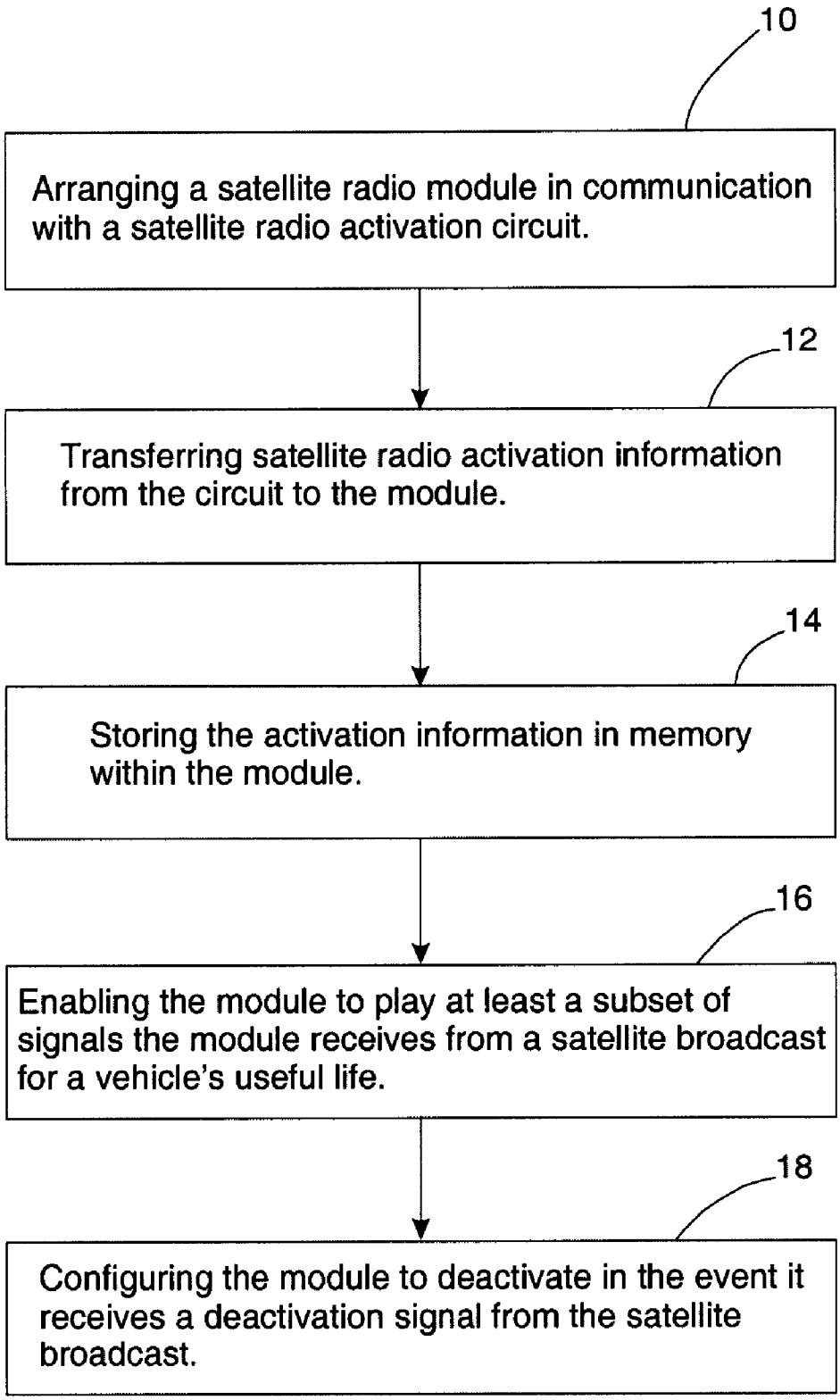
FIG. 1 shows a flow chart of a method of the present invention.

A down link processor (DLP), is communicably connected with an activation fixture. For example, the DLP may communicate with the activation fixture via a pin to pad connection. A DLP outfitted with a wireless receiver, for example, may communicate with an activation fixture outfitted with a wireless transmitter using a wireless protocol, e.g., 802.11. Any desired communication connection, e.g., infrared, between the DLP and the activation fixture may be used.

A microprocessor of the DLP receives information, e.g., firmware, transmitted by the activation fixture. The information is stored on the microprocessor's on-chip memory. The information, however, may be stored in any desired fashion.

The information determines which satellite radio channels will be active and which satellite radio channels will not be active. The DLP's active channels will remain active until the DLP receives a deactivation signal via a satellite broadcast.

The information also includes a unique identifier, e.g., an electronic serial number (ESN). The ESN is used to identify the module. The ESN may also be placed on the module, e.g., in bar code format, so that the ESN can be ascertained by inspection.

The DLP is then connected with a vehicle's communication system, power, and audio outputs via a 12-way connector; the DLP is connected with the vehicle's satellite radio antenna via a coaxial connection. The DLP, however, may be connected with the vehicle in any desired fashion.

The ESN and a vehicle identification number (VIN) associated with the vehicle are linked by, for example, querying the DLP for its ESN during an electrical check of the vehicle's electrical system or scanning a bar code on the DLP containing the ESN information. The VIN is already known while this querying or scanning operation takes place because the VIN is tracked throughout the vehicle assembly process. If the VIN is not known, the VIN information can be ascertained in any desired manner.

A file containing the VIN and ESN information is created and stored in a database along with the date the file containing the VIN and ESN information was created.

A satellite radio service provider is informed about the VIN and ESN information. For example, a signal is transmitted to the satellite radio service provider via the internet containing the VIN and ESN information along with the date the file containing the VIN and ESN information was created.

The satellite radio service provider tracks the VIN and ESN information. For example, the satellite radio service provider will track the VIN and ESN information for a period of six months. The six-month time period begins on the date the file containing the VIN and ESN information was created. If the satellite radio service provider is not informed that the vehicle was shipped from its manufacturing facility to a vehicle dealer within the six-month period of time, the satellite radio service provider will broadcast a deactivation signal for the DLP after the expiration of the six-month period of time.

When the vehicle leaves its manufacturing facility and is delivered to a vehicle dealer, information about the vehicle is gathered and stored. For example, information about the date on which the vehicle is shipped from its manufacturing facility to a dealer is associated with its VIN, e.g., scanned, and stored in a database.

The satellite radio service provider is informed about the shipping date information. For example, a signal is transmitted to the satellite radio service provider via the internet containing the shipping date information including the vehicle's VIN.

The satellite radio service provider tracks the shipping date information. For example, the satellite radio service provider will track the shipping date information for a period of fifteen months. The fifteen-month time period begins on the date the vehicle was shipped from its manufacturing facility to the dealer. If the satellite radio service provider is not informed that the vehicle was sold to a customer within the fifteen-month period of time, the satellite radio service provider will broadcast a deactivation signal for the DLP after the expiration of the fifteen-month period of time.

When the vehicle is sold to a customer, information about the sale is gathered, transmitted, and stored. For example, information about the date on which the vehicle is sold to a customer is associated with its VIN, e.g., input by the vehicle dealer, and stored in a database. The sale date information is transmitted to the vehicle's manufacturer via the internet. The vehicle's manufacturer stores the sale date information in a database.

The satellite radio service provider is informed about the sale date information. For example, a signal is transmitted to the satellite radio service provider via the internet containing the sale date information including the vehicle's VIN.

The satellite radio service provider tracks the sale date information. For example, the satellite radio service provider will track the sale date information for a period of six months. The six-month time period begins on the date the vehicle was sold to the customer. If the satellite radio service provider is not informed that the customer wishes to extend their service within the six-month period of time, the satellite radio service provider will broadcast a deactivation signal for the DLP after the expiration of the six-month period of time.

FIG. 1 shows a flow chart of a method of the present invention.

At step 10, a satellite radio module is arranged in communication with a satellite radio activation circuit. The module may be arranged in communication with the circuit via a physical data link or a wireless data link.

At step 12, satellite radio activation information is transferred from the circuit to the module. The activation information may include a module identification number.

At step 14, the satellite radio activation information is stored in memory within the module.

At step 16, the module is enabled to play at least a subset of signals the module receives from a satellite broadcast for the vehicle's useful life. The subset is defined by the activation information.

At step 18, the module is configured to deactivate in the event it receives a deactivation signal from the satellite broadcast.

Figure 2:
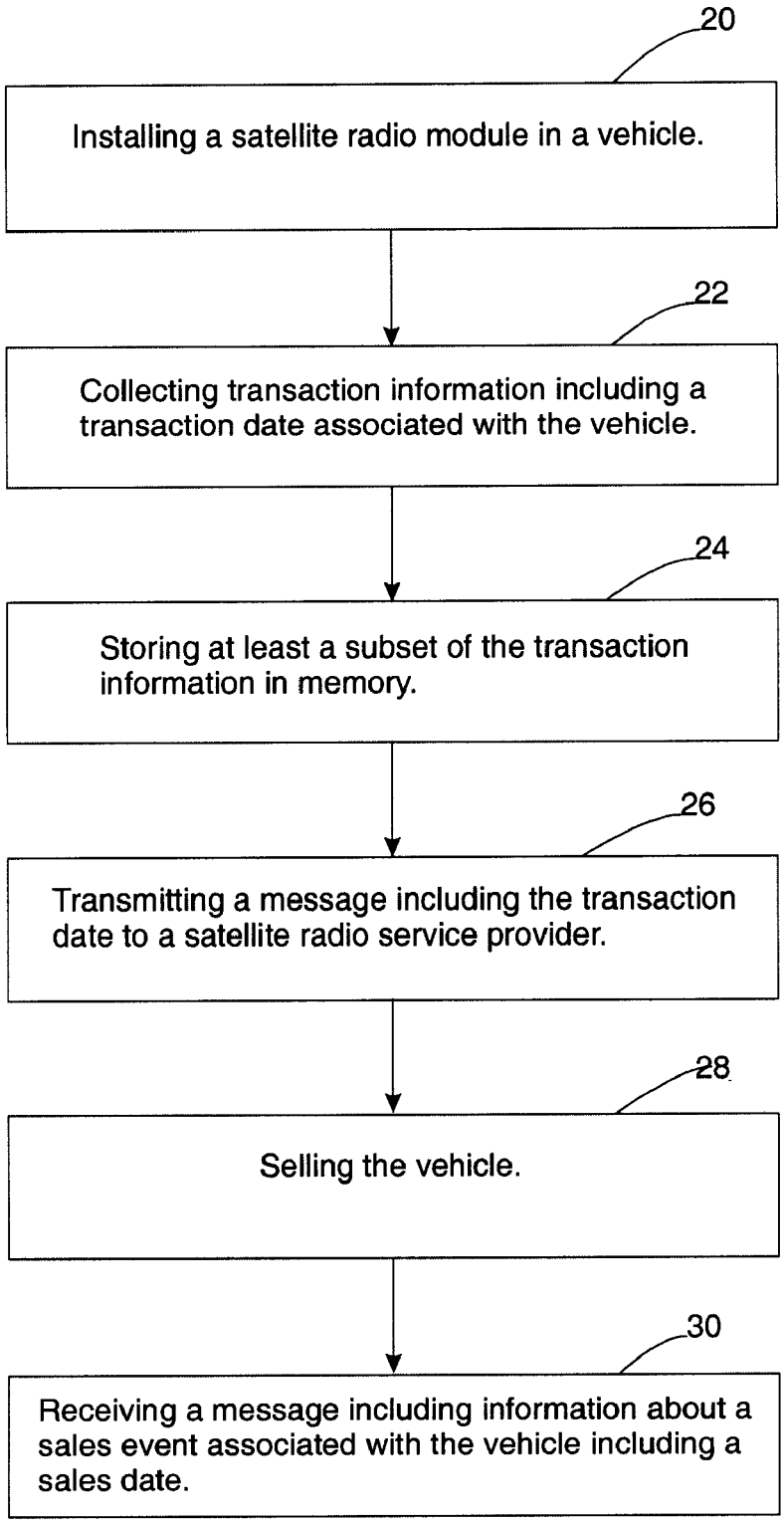
FIG. 2 shows a flow chart of a method of the present invention.

FIG. 2 shows a flow chart of a method of the present invention.

At step 20, a satellite radio module is installed in a vehicle. The module may include a module identification number. The vehicle may include a vehicle identification number. The module is enabled to play at least a subset of signals the module receives from a satellite broadcast for the vehicle's useful life. The subset is defined by activation information. The module is configured to deactivate in the event the module receives a deactivation signal from the satellite broadcast.

At step 22, transaction information including a transaction date associated with the vehicle is collected. The transaction information may include the module identification number. The transaction information may include the vehicle identification number. The transaction date may be a module installation date. The transaction date may be a shipping date. The transaction date may be a sales date.

At step 24, at least a subset of the transaction information is stored in memory.

At step 26, a message including the transaction date is transmitted to a satellite radio service provider such that a determination can be made regarding a preactivation duration.

At step 28, the vehicle is sold.

At step 30, A message including information about a sales event associated with the vehicle including a sales date is received.

Figure 3:
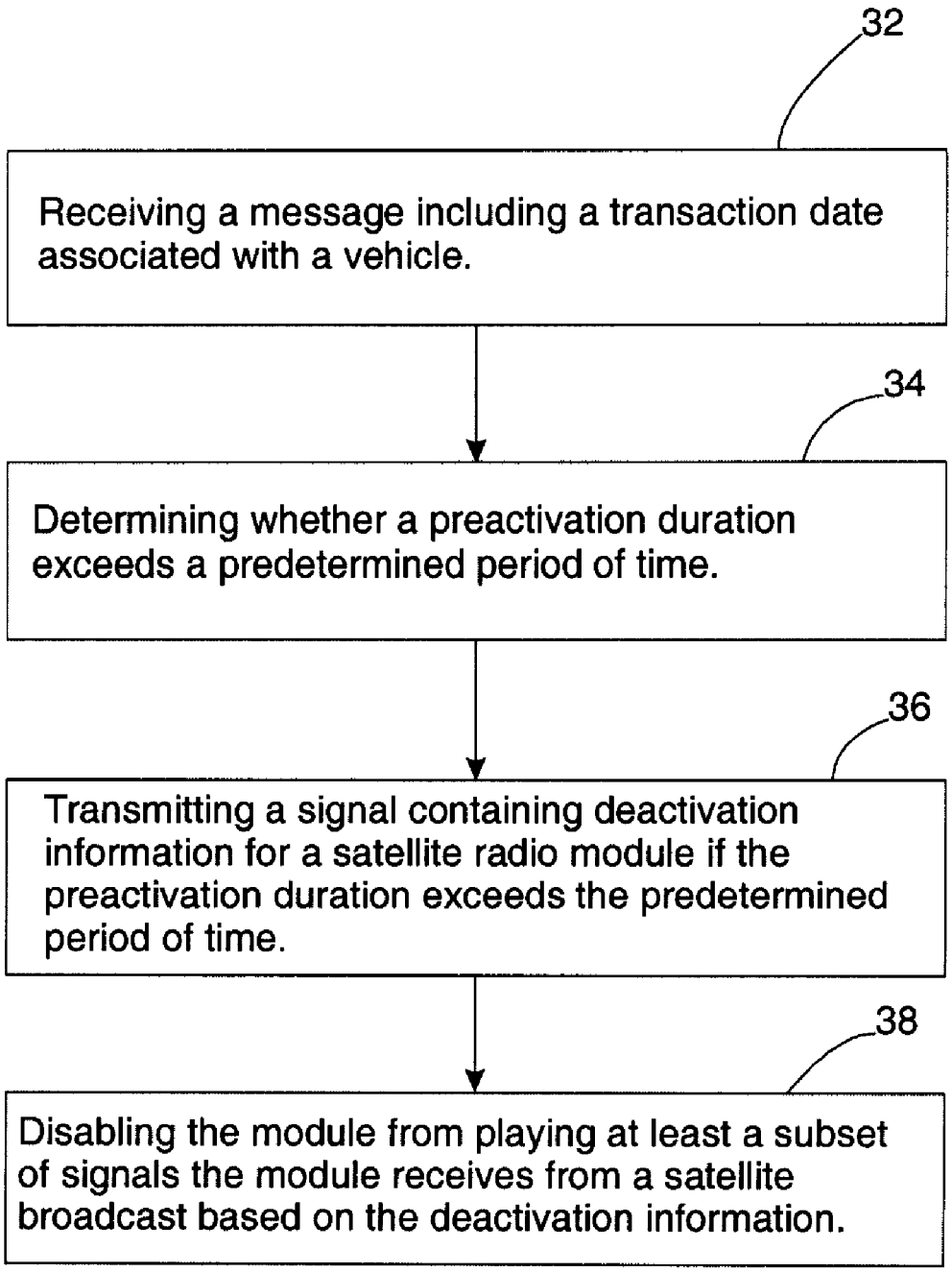
FIG. 3 shows a flow chart of a method of the present invention.

FIG. 3 shows a flowchart of a method of the present invention.

At step 32, a message including a transaction date associated with a vehicle is received. The message may come from a manufacturer. The message may include a module identification number for a satellite radio module installed in the vehicle or the vehicle's identification number. The transaction date is used to determine a preactivation duration. The transaction date may indicate the date on which the module was installed in the vehicle. The transaction date may indicate a date on which the vehicle was shipped. The transaction date may indicate a date on which the vehicle was sold. The preactivation duration may begin after the module is installed in the vehicle. The preactivation duration may begin after the vehicle is shipped. The preactivation duration may begin after the vehicle is sold.

At step 34, a determination is made as to whether the preactivation duration exceeds a predetermined period of time.

At step 36, a signal containing deactivation information for the module is transmitted if the preactivation duration exceeds the predetermined period of time.

At step 38, the module is disabled from playing at least a subset of signals the module receives from a satellite broadcast based on the deactivation information.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A method for providing satellite radio service in a vehicle comprising:

installing a satellite radio module in the vehicle, the module being (i) enabled to play at least a subset of signals the module receives from a satellite broadcast for the vehicle's useful life, the subset being defined by activation information, and (ii) configured to deactivate in the event the module receives a deactivation signal from the satellite broadcast;

collecting transaction information including a transaction date associated with the vehicle;

storing at least a subset of the transaction information in memory; and transmitting a message including the transaction date to a satellite radio service provider such that a determination can be made regarding a preactivation duration.

2. The method of claim 1 wherein the vehicle includes a vehicle identification number, and wherein the transaction information includes the vehicle identification number.

3. The method of claim 1 wherein the module includes a module identification number, and wherein the transaction information includes the module identification number.

4. The method of claim 3 wherein the transaction date is a module installation date.

5. The method of claim 1 wherein the transaction date is a shipping date.

6. The method of claim 1 further comprising receiving a message including information about a sales event associated with the vehicle including a sales date.

7. The method of claim 1 further comprising, after the step of installing the module in the vehicle, selling the vehicle.

8. The method of claim 1 wherein the transaction date is a sales date.

9. A method for providing satellite radio service for a satellite radio module in a vehicle comprising:

receiving a message including a transaction date associated with the vehicle, the transaction date used to determine a preactivation duration;

determining whether the preactivation duration exceeds a predetermined period of time;

transmitting a signal containing deactivation information for the module if the preactivation duration exceeds the predetermined period of time; and disabling the module from playing at least a subset of signals the module receives from a satellite broadcast based on the deactivation information.

10. The method of claim 9 wherein the preactivation duration begins after the module is installed in the vehicle.

11. The method of claim 10 wherein the message includes a module identification number or a vehicle identification number, and wherein the transaction date indicates the date on which the module was installed in the vehicle.

12. The method of claim 9 wherein the preactivation duration begins after the vehicle is shipped.

13. The method of claim 12 wherein the message includes a module identification number or a vehicle identification number, and wherein the transaction date indicates a date on which the vehicle was shipped.

14. The method of claim 9 wherein the preactivation duration begins after the vehicle is sold.

15. The method of claim 14 wherein the message includes a module identification number or a vehicle identification number, and wherein the transaction date indicates a date on which the vehicle was sold.

16. The method of claim 9 wherein the message comes from a vehicle manufacturer.

17. A method for providing satellite radio service for a satellite radio module in a vehicle comprising:

receiving a message including a transaction date associated with the vehicle, the transaction date used to determine a preactivation duration;

determining whether the preactivation duration exceeds a predetermined period of time; and transmitting a signal containing deactivation information for the module if the preactivation duration exceeds the predetermined period of time to disable the module from playing at least a subset of signals the module receives from a satellite broadcast.

18. The method of claim 17 wherein the preactivation duration begins after the vehicle is shipped.

19. The method of claim 18 wherein the message includes a module identification number or a vehicle identification number, and wherein the transaction date indicates a date on which the vehicle was shipped.

20. The method of claim 17 wherein the preactivation duration begins after the vehicle is sold.

* * * * *

UNITED STATES PATENT AND TRADEMARK OFFICE

CERTIFICATE OF CORRECTION

PATENT NO. : 7,613,435 B2
APPLICATION NO. : 11/426079
DATED : November 3, 2009
INVENTOR(S) : Reynolds et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 673 days.

Signed and Sealed this

Nineteenth Day of October, 2010

David J. Kappos

David J. Kappos
*Director of the United States Patent and Trademark Office*